US005598803A

United States Patent [19]

Czipri

[11] Patent Number: 5,598,803

[45] Date of Patent: Feb. 4, 1997

[54] LOW PROFILE RETRACTABLE LIFTING EYE

[75] Inventor: John Czipri, Clearwater, Fla.

[73] Assignee: Accon Marine, Inc., Clearwater, Fla.

[21] Appl. No.: 583,518

[22] Filed: Jan. 5, 1996

[51] Int. Cl.[6] ..... B63B 21/04

[52] U.S. Cl. ..... 114/218

[58] Field of Search ..... 114/218; D8/356, D8/382

[56] References Cited

U.S. PATENT DOCUMENTS

| | | | |
|---|---|---|---|
| 4,200,944 | 5/1980 | Gillespie et al. | 114/230 |
| 4,788,927 | 12/1988 | Casey | 114/218 |
| 4,964,355 | 10/1990 | Milewski | 114/218 |
| 5,301,627 | 4/1994 | Czipri | 114/218 |
| 5,438,944 | 8/1995 | Burke | 114/218 |

OTHER PUBLICATIONS

M&E Catalog, Marine Supply Company, Collingswood, NJ, p. 42, 1988.

*Primary Examiner*—Stephen Avila
*Attorney, Agent, or Firm*—Harold D. Shall

[57] ABSTRACT

A low profile retractable lifting eye assembly with a "U" shaped lifting eye pivotally mounted in a housing having a "U" shaped depression for receiving the eye in its depressed position. A pin extends transversely through the legs of the lifting eye and through the housing. A coupling member external of the housing has its upper end received in the middle of the depression in the housing and the upper end of the coupling members has an opening receiving the center of the pin. A set screw in the coupling member engages an annular groove in the pin to prevent transverse movement of the pin relative to the remainder of the assembly.

9 Claims, 3 Drawing Sheets

LOW PROFILE RETRACTABLE LIFTING EYE

BACKGROUND OF THE INVENTION

1.) Field of the Invention

This invention relates to improvement in lifting eyes generally and more particularly to retractable lifting eyes requiring minimal vertical space and, therefore, having a low profile, and which have a sealed housing to inhibit the flow of water therepast.

2.) Description of the Prior Art

In the last few years, a new generation of fishing boats has emerged in the market place, namely "flats" boats. These boats are used, primarily, to fish in shallow bay and estuary waters, since they have a very shallow draft; however, they also have a very low free board, which results in a small vertical space between the deck and the hull, particularly in the bow area of the boat. These flats boats also have a large flat deck area for the fishing user to stand and walk upon, while casting, retrieving, polling the boat, and otherwise in the fishing activity. Consequently it is desirable that objects do not protrude above the boat deck to interfere with the fishing persons feet, tackle, or other equipment. A cleat as shown in U.S. Pat. No. 5,301,627 is an example of a retractable cleat, which in its retracted or flush position, does not interfere with the fishing person, yet can be manipulated to an up right operative position as a lift eye or cleat. The problem with a device of this nature is that with the limited vertical height available in a flats boat, the vertical movement of the cleat of U.S. Pat. No. 5,301,627 requires more vertical space than the space available on a flats boat. Further, the housing for the cleat is not sealed to prevent the flow of water therepast.

SUMMARY OF THE INVENTION

It is a object of this invention to provide a retractable lifting eye which has a low profile in that it requires a minimum vertical height when retracted.

It is another object of this invention to provide such a lifting eye which has a housing which is enclosed to prevent the flow of water therepast.

It is yet another object of this invention to provide such a lifting eye wherein the member for securing the lifting eye to the hull pivotally mounts the eye relative to the deck mounted housing which receives the eye when it is pivoted to its flush position.

These and other objects of this invention will become apparent from the above, the following specification and claims and the following drawings.

DETAILED DESCRIPTION OF THE PREFERRED EMBODIMENT

Figure 1:
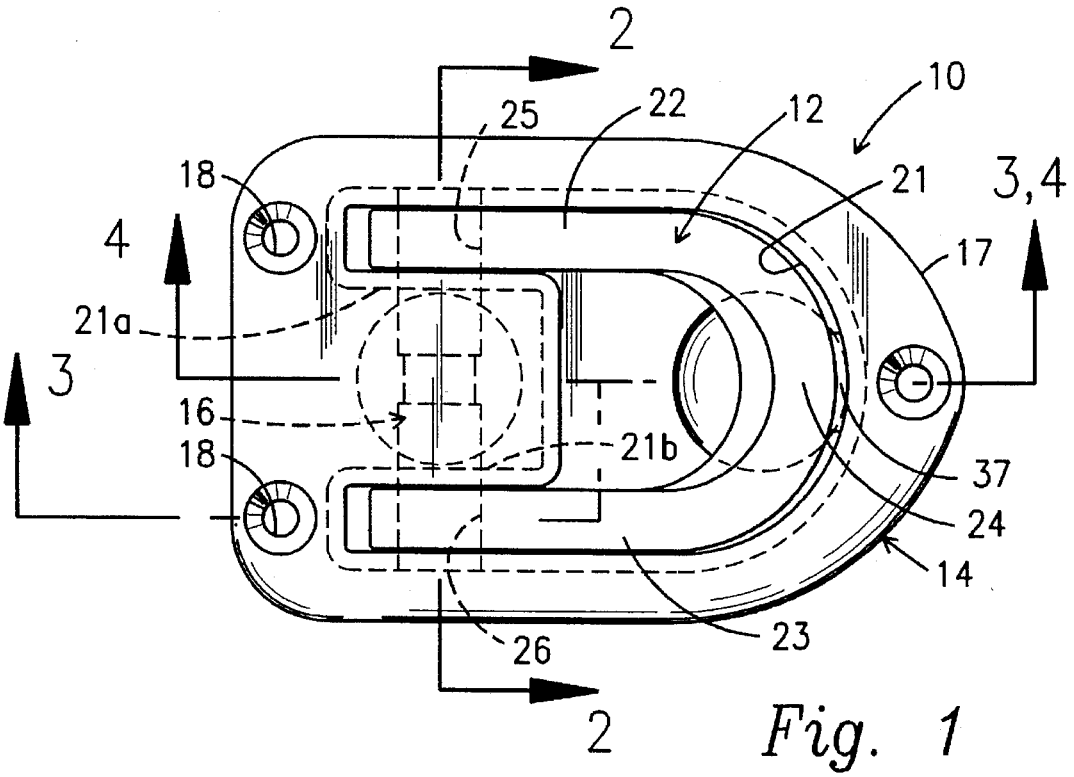
FIG. 1 is a plan view of a lifting eye according to this invention, shown in its depressed or flush position.
Figure 2:
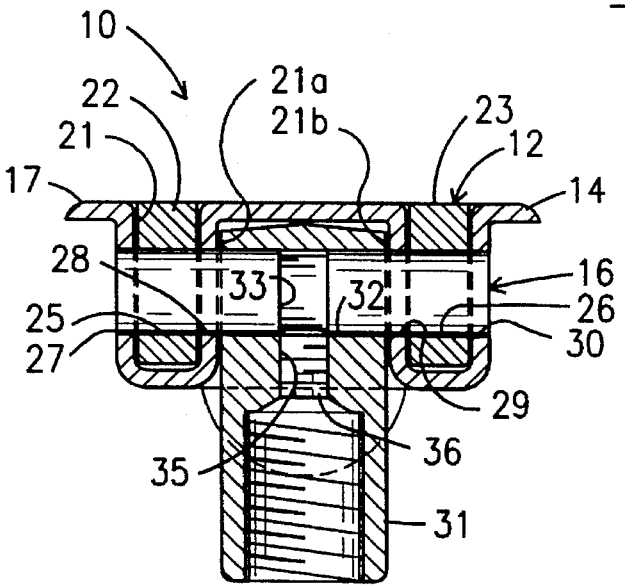
FIG. 2 is a cross sectional view taken along the lines 2—2 in FIG. 1.
Figure 5:
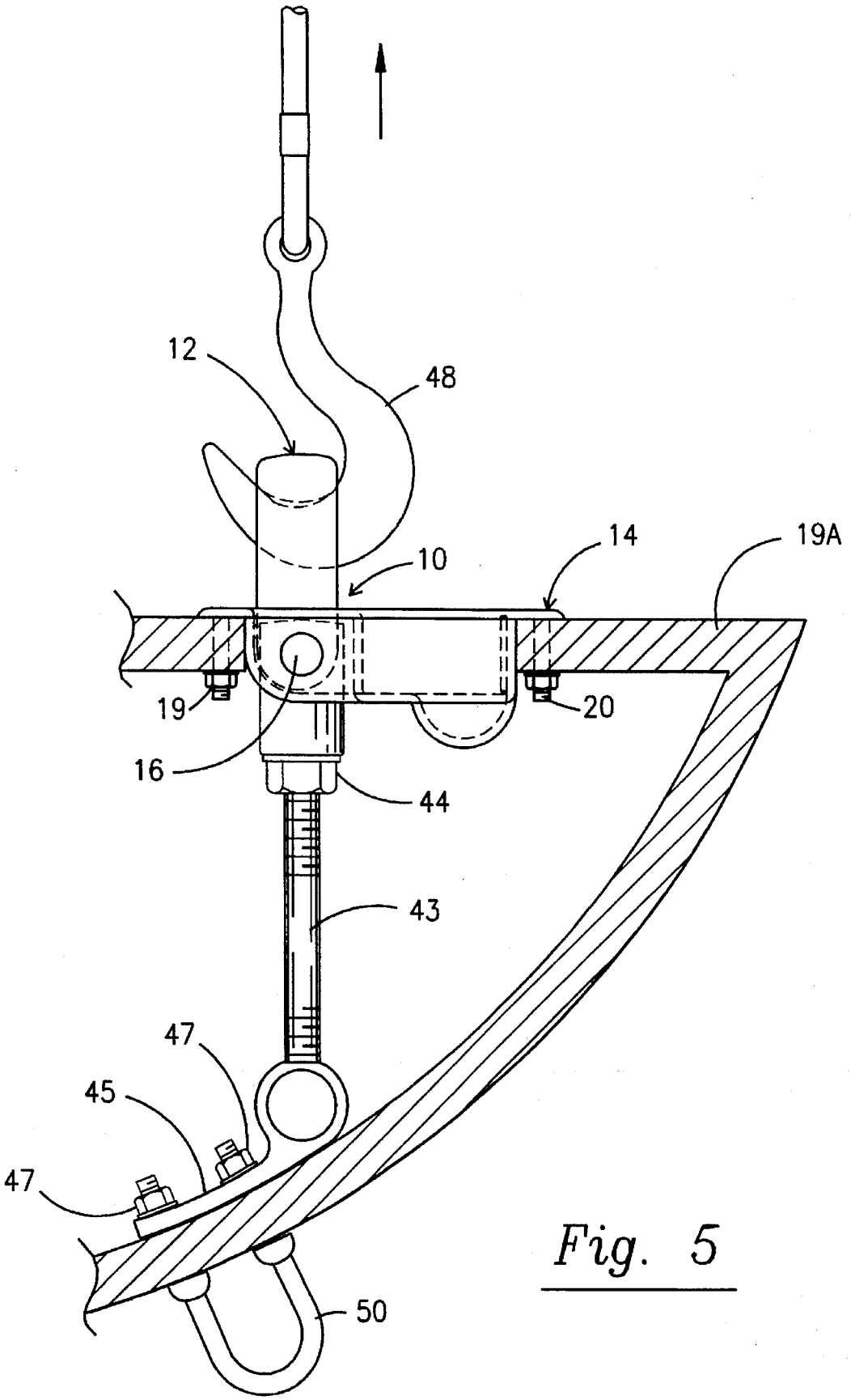
FIG. 5 is a side elevational view of a lifting eye according to this invention shown installed on a boat hull shown in cross-section with a lifting hook engaged in the lifting eye; the latter being shown in its upright, operative position.
Figure 3:
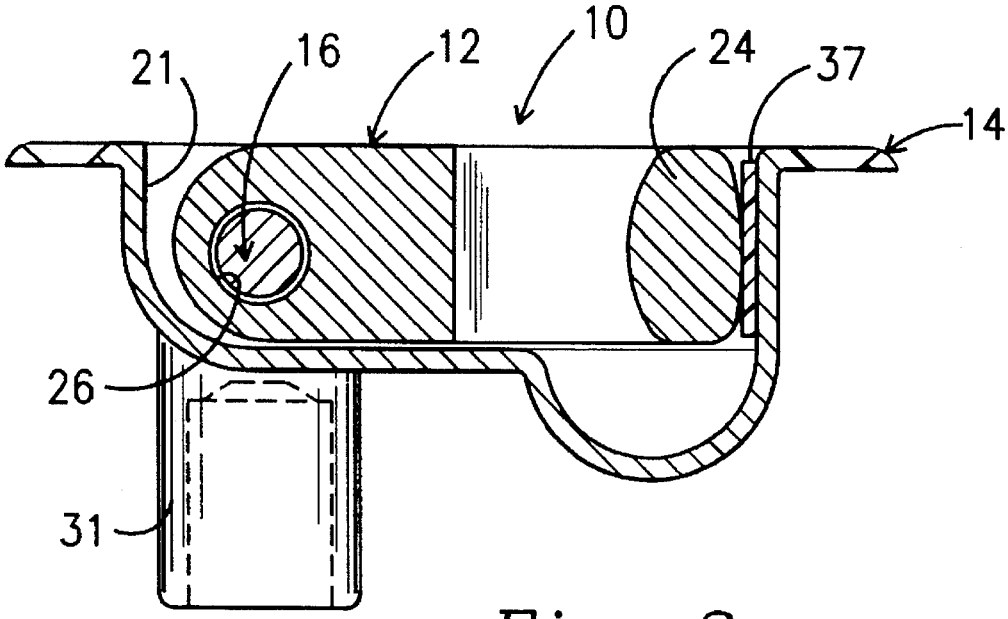
FIG. 3. is a view taken along the lines 3—3 in FIG. 1.
Figure 4:
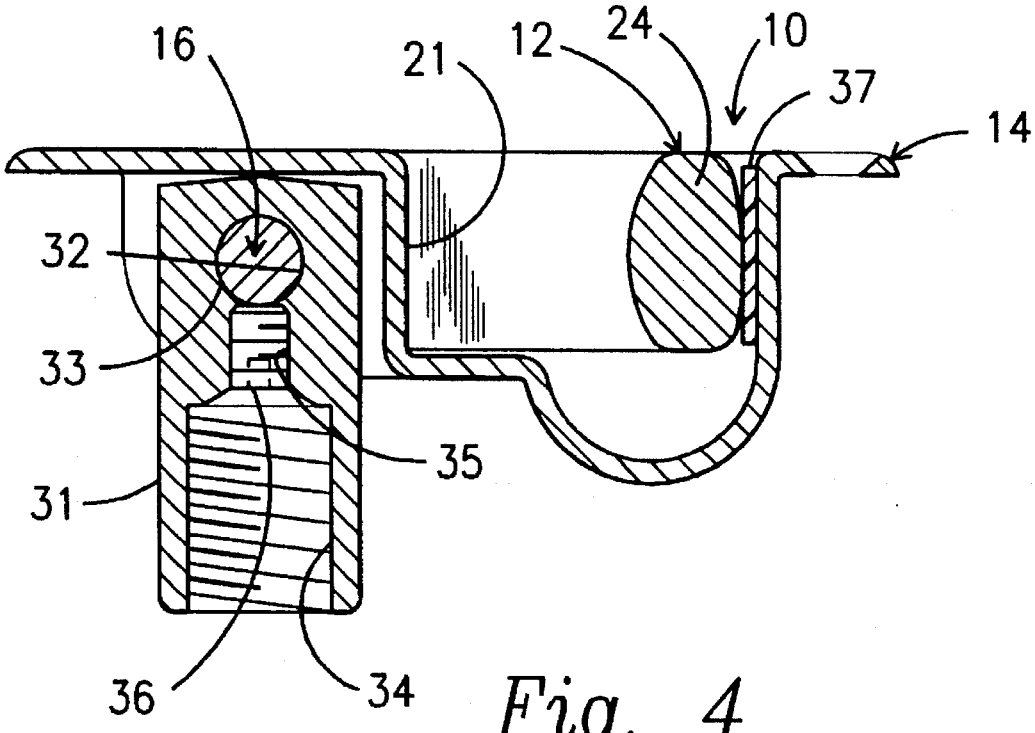
FIG. 4 is a view taken along the lines 4—4 in FIG. 1.

Referring now to the drawings, a lifting eye assembly is shown generally at 10 and includes a lifting eye 12 of generally "U" shaped configuration pivotally mounted to a housing 14 by a pivot and securing pin 16. The housing 14 has a peripheral flange 17 in which is machined a plurality of countersunk bolt receiving openings 18, which openings, as seen in FIG. 5, receive through bolts 20 extending through the boat deck 19A and which have a nut 19 thereon securing the housing 14 to the deck.

The housing 14 has a "U" shaped cavity or channel 21 formed therein which registers with and receives the "U" shaped lifting eye 12 when the latter is in its depressed or flush position as shown in FIGS. 1–4. The lifting eye 12 has a pair of transversely spaced legs 22 and 23 interconnected by an arcuate portion 24. The legs 22 and 23 adjacent the ends thereof each has an opening 25 and 26, respectively, which are aligned with each other and pivotally receive the opposed outer ends of the pivot and securing pin 16. The pivot pin 16 extends transversely and is secured by and sealingly pressed into align openings 27, 28, 29 and 30 formed in the housing 14. Into the space between the channel 21 is the upper end of a coupling member 31, which upper end has a transversely extending opening 32 receiving the medial portion of the pin 16. The transverse sides of the coupling member 31 engage the sides of the channel 21 as shown at 21A and 21B. The center of the pin 16 has an annular groove 33 formed therein. A threaded opening 34 is formed axially inwardly from the bottom end of the coupling member 31 and a threaded counter bore 35 is formed at the inner end of the opening 34. A set screw 36 is threaded into the counter bore 35 with the upper end of the set screw securedly engaged in the groove 33 in the pin 16 to thereby prevent transverse movement of the pin 16 relative to the coupling member 31 and also relative to the lifting eye 12 and also relative to the housing 14. Because of the coupling member 31 engages the sides of the channel 21 at 21*a* and 21*b* the coupling member and the pin do not move transversely relative to the housing 14. A resilient block of material in the form of a bumper 37 is carried by the housing 14 in the front end of the channel 21 and engages the front end of the arcuate portion 24 of the lift eye 12 when the lifting eye is in its flush position to thereby resiliently maintain the lifting eye in its flush position without rattling or bouncing.

A threaded connecting member 43 is threaded into the opening 34 and a jam nut 44 holds the same in place. The lower end of the member 43 is threaded into an inner securing member 45, which receives the inner ends of the legs of a "U" shaped towing member 50 (also used as a connector to winch the boat onto a trailer) and is secured thereto by nuts 47. As seen in FIG. 5, with the lifting eye 12 in its upright position, a hook 48 can engage the eye to lift the boat. Since the lower end of the coupling member can be moved slightly fore and aft by rotation of the pin 16, the position of the inner securing member 45 relative to the hull can be varied somewhat to accommodate a variety of hull configurations. Also, since the only openings in the housing 14, namely openings 27, 28, 29, and 30 sealingly receive the pin 16, no water can leak past the lifting eye assembly 10 and into the boat hull.

Although the above description relates to a presently preferred embodiment, numerous changes can be made therein without departing from the scope of this invention as claimed in the following claims.

What is claimed is:

1. A low profile retractable lifting eye comprising in combination, a) a housing adapted to be sealingly and securely received by a boat deck, b) a lifting eye having a depressed and upright position, c) a depressed area in said housing for receiving said lifting eye when the latter is in its depressed position, d) aligned transversely extending openings in said housing, e) a transversely extending opening means in said lifting eye aligned with the openings in said housing, f) transversely extending pin means sealingly and securely received in said housing openings and pivotally received in said lifting eye opening means, g) a securing portion of said pin means extending out of said housing openings, and h) a coupling member having a transverse opening therein securely receiving said securing portion of said pin means i) said coupling member having securing means thereon for directly securing to a hull engaging connecting member whereby a lifting force on said lifting eye is directly imposed through the coupling member to the hull.

2. A lifting eye according to claim 1 wherein said housing has bolt receiving openings adjacent the periphery thereof for receiving bolts therein for securing the said housing to a boat deck, and said bolt receiving openings and said transversely extending openings in said housing are the only openings through said housing.

3. A lifting eye according to claim 2 wherein said securing means on said coupling member is an axially extending threaded bore therein for receiving a connecting member, and said axially extending bore has a threaded counter bore therein which opens into the transverse opening in said coupling member, and a set screw in said counter bore engages said pin means.

4. A lifting eye according to claim 3 wherein said pin means has an annular groove therein and said set screw is received in said annular groove to thereby inhibit transverse movement of said pin means relative to said coupling member.

5. A lifting eye according to claim 4 wherein said housing has transversely opposed engaging surfaces, said coupling member engages said engaging surfaces on said housing on opposed transverse sides thereof whereby said coupling member and said pin means are prevented from moving transversely relative to said housing.

6. A low profile retractable lifting eye comprising in combination, a) a housing adapted to be sealingly and securely received by a boat deck, b) a "U" shaped lifting eye having a depressed and an upright position, with said eye having a pair of opposed parallel legs joined by an arcuate section, c) said housing having a depressed substantially "U" shaped area therein for entirely receiving said lifting eye when the latter is in its depressed position and for receiving the outer ends of said parallel legs when said eye is in its upright position, whereby said depressed area has a pair of opposed transversely spaced channels, d) said housing having first hole means therein extending transversely therethrough, e) said lifting eye having second hole means extending transversely therethrough adjacent the outer ends of said parallel legs, with said second hole means aligned with said first hole means, f) pin means extending transversely through said first and second hole means, said pin means securely received in said first hole means and pivotally received in said second hole means whereby said lifting eye is pivotally mounted relative to said housing, g) a coupling member having an upper end received in the space between said transversely spaced channels of said housing and having a transversely extending opening in said upper end receiving said pin means, and h) said coupling member having securing means thereon for directly securing to a hull engaging connecting member whereby a lifting force on said lifting eye is directly imposed through the coupling member to the hull.

7. A lifting eye according to claim 6 wherein said securing means on said coupling member is the lower end of said coupling member having a central threaded bore therein for receiving a connecting member, said coupling member has a threaded counter bore in said upper end of said central bore, and a set screw received in said central bore engages said pin and prevents transverse movement thereof.

8. A lifting eye according to claim 7 wherein said pin has an annular groove therein receiving said set screw.

9. A lifting eye according to claim 8 wherein said housing has bolt receiving openings adjacent the periphery thereof for receiving bolts therein for securing said housing to a boat deck and said bolt receiving openings and said first hole means are the only opening through said housing.

* * * * *